US006640690B2

(12) United States Patent
Sugiura et al.

(10) Patent No.: US 6,640,690 B2
(45) Date of Patent: Nov. 4, 2003

(54) SWASH PLATE TYPE COMPRESSOR AND SHOE FOR THE SAME

(75) Inventors: Manabu Sugiura, Kariya (JP); Takahiro Sugioka, Kariya (JP); Akira Onoda, Kariya (JP); Tomohiro Murakami, Kariya (JP); Shino Okubo, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/132,809

(22) Filed: Apr. 24, 2002

(65) Prior Publication Data

US 2002/0178904 A1 Dec. 5, 2002

(30) Foreign Application Priority Data

Apr. 25, 2001 (JP) ..... 2001-127366

(51) Int. Cl.[7] ..... F04B 27/08
(52) U.S. Cl. ..... 92/71; 92/155
(58) Field of Search ..... 92/71, 155, 12, 92/2; 74/60; 417/269

(56) References Cited

U.S. PATENT DOCUMENTS 5,943,941 A * 8/1999 Kato et al. ..... 92/71
6,289,785 B1 * 9/2001 Ikeda et al. ..... 92/71

FOREIGN PATENT DOCUMENTS

| | | | | |
|---|---|---|---|---|
| JP | 60022080 A * | 2/1985 | ..... | F04B/25/04 |
| JP | 62-041980 | 2/1987 | ..... | F04B/27/08 |
| JP | 05-086482 | 4/1993 | ..... | C23C/18/52 |
| JP | 07-083165 | 3/1995 | ..... | F04B/27/08 |
| JP | 2000-274361 | 10/2000 | ..... | F04B/39/00 |

OTHER PUBLICATIONS

U.S. patent application Ser. No. 10/010,834, Sugiura et al., filed Dec. 4, 2001.

* cited by examiner

*Primary Examiner*—Edward K. Look
*Assistant Examiner*—Thomas E. Lazo
(74) *Attorney, Agent, or Firm*—Morgan & Finnegan, LLP

(57) ABSTRACT

A shoe for use in a swash plate type compressor, interposed between a swash plate and a piston, has a base member and metal plating layer. The base member is made of aluminum alloy. The metal plating layer coats at least a part of surface of the base member. The thickness of the metal plating layer ranges from 20 $\mu$m to 150 $\mu$m.

33 Claims, 2 Drawing Sheets

SWASH PLATE TYPE COMPRESSOR AND SHOE FOR THE SAME

BACKGROUND OF THE INVENTION

The present invention relates to a shoe interposed between a swash plate and a piston in a swash plate type compressor and more particularly to a shoe made of aluminum alloy and a swash plate type compressor with the shoe.

A swash plate type compressor compresses gas by converting rotation of a swash plate to reciprocation of a piston. A pair of shoes as sliding members is interposed between the swash plate, which rotates at high speed, and the piston, which reciprocates at high speed, to ensure smooth operations of the swash plate and the piston. For example, a swash plate type compressor used for an air conditioner of a vehicle is especially required to be light in weight, and making a shoe, which is one of the components of the compressor, out of aluminum alloy has been conceived to lighten the compressor.

The shoe slides with respect to the swash plate and the piston, and the swash plate and the piston are also often made of aluminum alloy. In such a state, since members made of materials of the same kind slide with respect to each other, seizure easily arises. Therefore, it has been proposed that a layer, which is made of a material other than aluminum, coats at least one of sliding surfaces. Also, when the swash plate or the piston is not made of aluminum alloy, and, for example, when the swash plate is made of iron series, the shoe slides under hard conditions. Thereby, seizure may arise. The shoe is also required to improve its durability because of the hard conditions. In such a state, to inhibit seizure and improve durability, it has been proposed that metal plating, which is made of a material other than aluminum alloy, coats the surface of the shoe made of aluminum alloy.

An unwanted effect is that aluminum alloy is inferior in strength and hardness, so that the aluminum alloy is easily flawed. For example, in a process of assembling a swash plate type compressor, when a shoe abuts against another component upon assembling the shoe, the shoe is easily flawed. When the thickness of the metal plating is relatively thin, a base member made of aluminum alloy is not inhibited from deforming even if hard metal plating coats the is shoe. Therefore, the base member is flawed. Also, for example, a foreign substance such as metallic dust is trapped in between the swash plate and the shoe upon operating, and the shoe is flawed due to the foreign substance. In such a state, when the thickness of the metal plating is relatively thin, the base member is also flawed and deformed. The shoe flawed like that causes the facing sliding surfaces of the swash plate and the piston to be flawed. Particularly, the surface of the swash plate is generally coated with a lubricant layer to reduce friction generated between the swash plate and the shoe due to a hard sliding operation. Therefore, the lubricant layer is torn off by the flaws. As the lubricant layer is removed, the base member or the metal plating of the swash plate progressively abrades, with a consequence of arising seizure. Therefore, the flaws described above should be inhibited as much as possible such that the shoe slides smoothly.

SUMMARY OF THE INVENTION

The present invention addresses the above-mentioned problems by improving a layer formed on a shoe.

According to the present invention, a shoe for use in a swash plate type compressor, interposed between a swash plate and a piston, has a base member and metal plating layer. The base member is made of aluminum alloy. The metal plating layer coats at least a part of surface of the base member. The thickness of the metal plating layer ranges from 20 $\mu$m to 150 $\mu$m.

The present invention also provides a swash plate type compressor having a housing, a drive shaft, a swash plate, a piston, and a pair of shoes. The drive shaft is rotatably supported by the housing. The swash plate is operatively connected to the drive shaft. The piston is accommodated in the housing, and is operatively connected to the swash plate. The pair of shoes is interposed between the swash plate and the piston. Each of the shoes includes a base member and metal plating layer. The base member is made of aluminum alloy. The metal plating layer coats at least a part of surface of the base member. The thickness of the metal plating layer ranges from 20 $\mu$m to 150 $\mu$m.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

An embodiment of the present invention will now be described with reference to FIGS. 1 and 2. A shoe constituting a swash plate type compressor for use in an air conditioner of a vehicle will be described, for example. The front side and the rear side correspond to the left side and the right side in FIG. 1, respectively.

Figure 1:
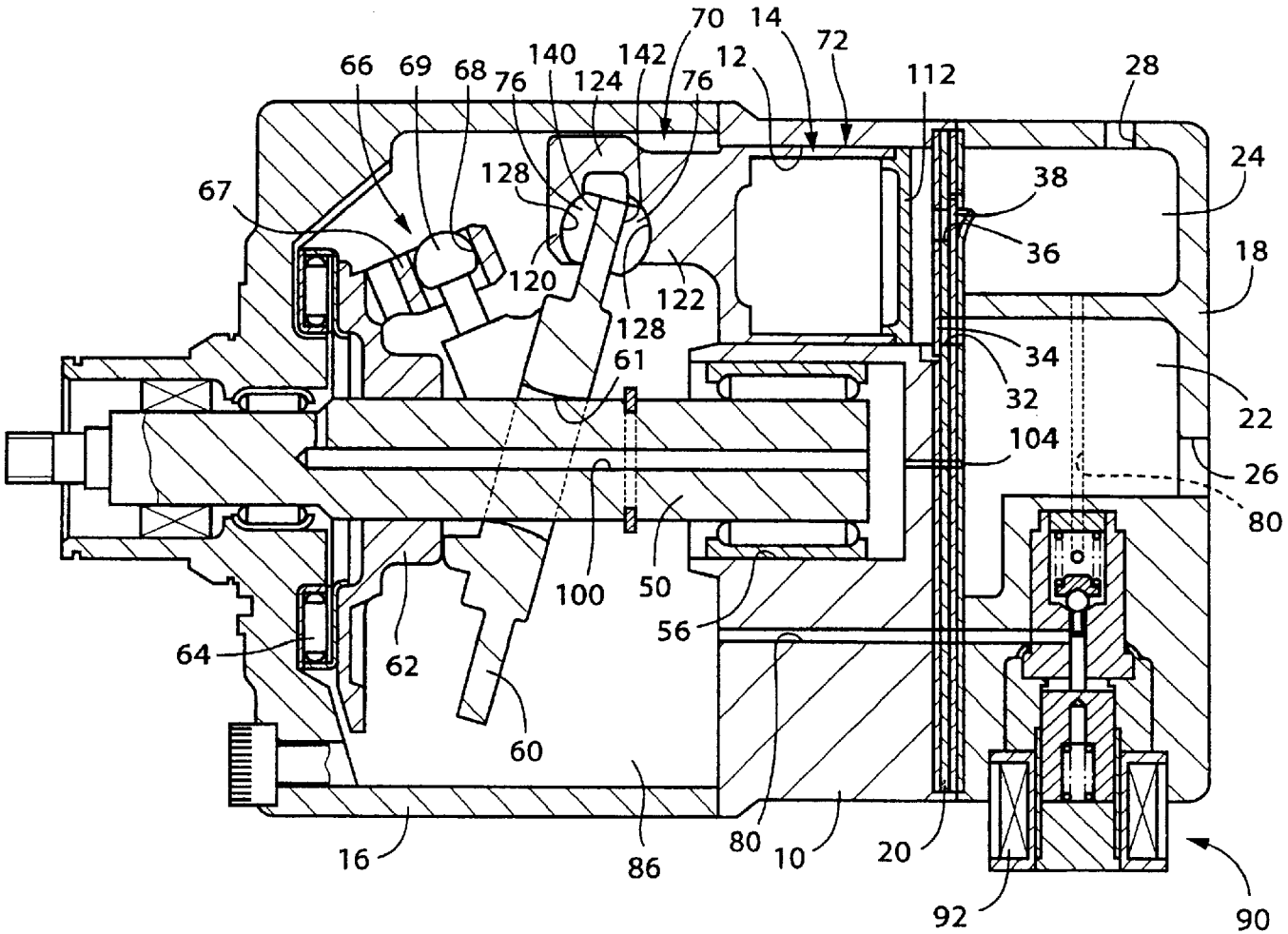
FIG. 1 s a longitudinal cross-sectional view of a swash plate type compressor provided with a shoe according to an embodiment of the present invention.

As shown in FIG. 1, the reference numeral 10 denotes a cylinder block, and a plurality of cylinder bores 12 is defined in the cylinder block 10 on an identical circumference relative to the central axis of the cylinder block 10. The cylinder bores 12 extend in a direction of the central axis of the cylinder block 10. Each of the cylinder bores 12 accommodates a single-headed piston 14 so as to reciprocate. The front end surface of the cylinder block 10 connects with a front housing 16, and the rear end surface of the cylinder block 10 connects with a rear housing 18 through a valve plate assembly 20. The front housing 16, the rear housing 18 and the cylinder block 10 constitute a housing of the swash plate type compressor. A suction chamber 22 and a discharge chamber 24 are defined between the rear housing 18 and the valve plate assembly 20, and connect with an external refrigerant circuit, which is not shown, through an inlet 26 and an outlet 28, respectively. The valve plate assembly 20 forms a suction port 32, a suction valve 34, a discharge port 36 and a discharge valve 38.

A drive shaft 50 is supported by the housing so as to rotate with respect to the central axis of the cylinder block 10. The front housing 16 and the cylinder block 10 support the front end and the rear end of the drive shaft 50 through bearings, respectively. The cylinder block 10 forms a support hole 56 along its central axis, and the rear end of the drive shaft 50 is supported by the support hole 56. The front end of the drive shaft 50 connects with an engine of a vehicle as a driving source, which is not shown, through a clutch mechanism such as an electromagnetic clutch. Therefore, as the drive shaft 50 connects with the engine by the clutch mechanism upon an operation of the engine, the drive shaft 50 rotates around the axis thereof.

A swash plate 60 is operatively connected to the drive shaft 50 such that the swash plate 60 tilts and relatively moves in a direction along the axis of the drive shaft 50. The swash plate 60 forms a through hole 61 along its central axis, and the drive shaft 50 extends through the through hole 61. The through hole 61 gradually increases in diameter toward both opening ends of the through hole 61, and the cross sections of the opening ends are oblong holes. A lug plate 62 is secured to the drive shaft 50, and is supported by the front housing 16 through a thrust bearing 64. The swash plate 60 integrally rotates with the drive shaft 50 and tilts with respect to the axis of the drive shaft 50 through a hinge mechanism 66. The hinge mechanism 66 is constituted of a pair of support arms 67 fixed to the lug plate 62, a pair of guide pins 69 slidably fitted into a pair of guide holes 68 of the support arms 67, the through hole 61 of the swash plate 60, and the outer circumferential surface of the drive shaft 50.

The piston 14 includes an engaging portion 70 and a head 72. The engaging portion 70 overpasses the periphery of the swash plate 60. The head 72 formed with the engaging portion 70 is fitted into the cylinder bore 12. The head 72 in the present embodiment is a hollow head to be light in weight. The head 72, the cylinder bore 12 and the valve plate assembly 20 cooperatively define a compression chamber. Also, the engaging portion 70 engages with the periphery of the swash plate 60 through a pair of shoes 76, which is substantially hemispherical. The shoes 76 will be described later.

Rotation of the swash plate 60 is converted to reciprocation of the piston 14. As the piston 14 moves from a top dead center toward a bottom dead center, refrigerant gas in the suction chamber 22 is sucked into the compression chamber in the cylinder bore 12 through the suction port 32 and the suction valve 34. As the piston 14 moves from the bottom dead center toward the top dead center, the refrigerant gas in the compression chamber in the cylinder bore 12 is compressed and discharged to the discharge chamber 24 through the discharge port 36 and the discharge valve 38. Compression reactive force acts on the piston 14 in a direction along the axis of the drive shaft 50 in accordance with compressing the refrigerant gas. The front housing 16 receives the compression reactive force through the piston 14, the swash plate 60, the lug plate 62 and the thrust bearing 64.

The cylinder block 10 forms a supply passage 80 so as to extend through the cylinder block 10. The supply passage 80 interconnects the discharge chamber 24 and a crank chamber 86, which is defined between the front housing 16 and the cylinder block 10. A control valve 90 is interposed in the supply passage 80. The value of an electric current supplied to a solenoid 92 of the control valve 90 is controlled by a controller mainly constituted of a computer, which is not shown, based on information such as cooling load.

The drive shaft 50 forms a bleed passage 100 inside. The bleed passage 100 opens its one end to the support hole 56, and opens its other end to the crank chamber 86. The support hole 56 interconnects with the suction chamber 22 through a bleed port 104.

The swash plate type compressor in the present embodiment is a variable displacement type. The pressure in the crank chamber 86 is controlled by utilizing pressure differential between the discharge chamber 24 as a relatively high pressure region and the suction chamber 22 as a relatively low pressure region. Thereby, pressure differential between the pressure in the compression chamber in the cylinder bore 12 applied to the pistons 14 and the pressure in the crank chamber 86 is adjusted, and strokes of the pistons 14 are varied by varying the inclination angle of the swash plate 60, thus adjusting the displacement of the compressor. Additionally, the crank chamber 86 disconnects from the discharge chamber 24 by energizing the control valve 90, and the crank chamber 86 interconnects with the discharge chamber 24 by de-energizing the control valve 90. Thereby, the pressure in the crank chamber 86 is controlled.

The cylinder block 10 and the pistons 14 are made of aluminum alloy. The outer circumferential surfaces of the pistons 14 are coated with fluororesin. Since the pistons 14 are coated with fluororesin, seizure is inhibited by avoiding directly contacting with a metal of the same kind, and clearances between the cylinder block 12 and the pistons 14 are drastically reduced. Besides, the material of the cylinder block 10, the pistons 14 and the coating layers are not limited as described above, but may be changed into other materials.

The engaging portions 70 of the pistons 14 are substantially U-shaped. The engaging portions 70 each provide a pair of arms 120, 122 and a connecting portion 124. The pair of arms extends in parallel with each other in a direction perpendicular to the central axis of the head 72. The connecting portion 124 interconnects the bases of the arms 120, 122. The facing surfaces of the arms 120, 122 form spherical concave surfaces 128 for supporting the shoes 76, respectively. The spherical concave surfaces 128 cooperatively form a part of identical hypothetical spherical surface.

Figure 2:
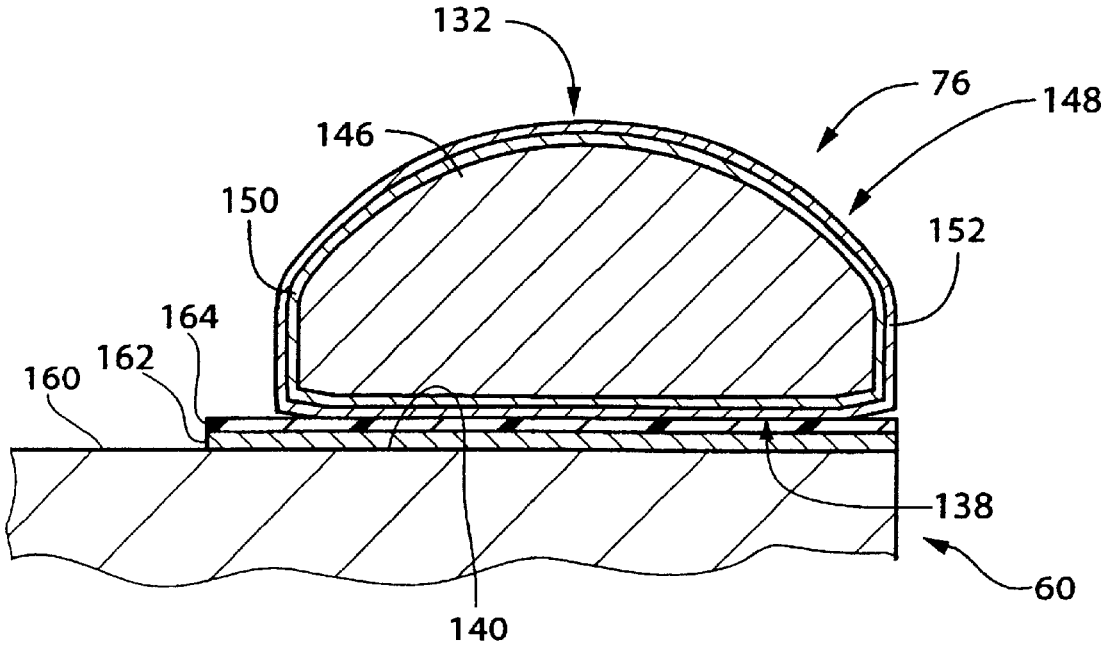
FIG. 2 is an enlarged partially cross-sectional view of a shoe and a swash plate in FIG. 1.

As shown in FIG. 2, the shoes 76 each provide a spherical surface 132 on one end and a plane surface 138 on the other end. The spherical surface 132 forms substantially a spherical convex surface. The plane surface 138 forms substantially a plane. Strictly, the plane surface 138 forms a convex surface, the radius of curvature of which is very large, and the outer periphery of the plane surface 138 is slightly chamfered. Also, strictly, the spherical surface 132 adjacent to the plane surface 138 forms a cylindrical surface. Boundaries among the convex surface of the plane surface 138, the chamfered outer periphery of the plane surface 138, the cylindrical surface, and the spherical surface 132 other than the cylindrical surface are rounded in the small radius of curvature. The spherical surfaces 132 of the pair of shoes 76 are slidably supported by the spherical concave surfaces 128 of the piston 14. The plane surfaces 138 of the pair of shoes 76 are in contact with sliding surfaces 140, 142, which are formed on both surfaces of the swash plate 60 at the outer peripheral portion. Thereby, the shoes 76 sandwich the surfaces of the swash plate 60 at the outer peripheral portion. In other words, the plane surfaces 138 of the shoes 76 slide with respect to the swash plate 60, and the spherical surfaces 132 of the shoes 76 slide with respect to the piston 14. Besides, the spherical surfaces 132 of the pair of shoes 76 cooperatively form a part of identical hypothetical spherical surface. Namely, the shoe 76 in the present embodiment is substantially a part of sphere, the thickness of which is approximately a half of the thickness of the swash plate 60 less than a hemisphere. Therefore, the shoe 76 is generally called a hemispherical crown shoe. However, to improve sliding performance, a spherical surface and a plane surface of the hemispherical shoe are mostly modified from a strict spherical surface and a strict plane surface. Also, strictly, a shoe for use in a variable displacement compressor is smaller than a hemisphere, and a shoe for use in a fixed displacement compressor is larger than a hemisphere. In the variable displacement compressor, since both spherical surfaces of the pair of shoes disposed on each side of the swash plate are required to cooperatively form a part of identical hypothetical spherical surface, the shoe is substantially a part of sphere, and the thickness of the shoe is substantially a half of the thickness of the swash plate less than a hemisphere. On the other hand, in the fixed displacement compressor, since no such limitations as that of the variable displacement compressor is required, the shoe is substantially a part of sphere. However, the thickness of the shoe is more than a hemisphere to inhibit the area of the sliding surface of the shoe from reducing even if the plane surface is abraded.

Each of the shoes 76 includes a base member 146 and a metal plating layer 148, which coats the surface of the base member 146. The metal plating layer 148 includes two layers 150, 152, which are an outer layer 152 for forming the surface of the metal plating layer 148 and an inner layer 150 interposed between the outer layer 152 and the base member 146. Besides, the thickness of the metal plating layer 148, that is, the thickness of the inner layer 150 and the outer layer 152, shown in FIG. 2 is exaggerated for easier understanding.

The base member 146 is made of Al—Si series alloy corresponding to A4032, which is mainly made of aluminum and contains silicon. Besides, the material of the base member 146 of the shoe 76 in the present embodiment is not limited to Al—Si series alloy, but may be made of various kinds of aluminum alloy. Also, the manufacturing process of the shoe 76 will now be described in the following, for example. A cylindrical bar in predetermined diameter is used as a material. The cylindrical bar is formed by extruding process from a predetermined shaped billet, which is made by molding process of a predetermined composition of aluminum alloy. The cylindrical bar is cut in a predetermined length by a shearing machine or a sawing machine. Then, the cut material is cold forged by a pressing machine, thus forming the cut material into the substantial shape of the shoe. Besides, the manufacturing process of the shoe in the present embodiment is not limited to cool forging, but the shoe may be formed by another known manufacturing process, such as one or combination of hot forging, casting, punching by pressing, and machining. Also, the shoe formed into its substantial shape may be performed with heat treatment. Upon heat treatment, after solution heat treatment, the shoe is performed with artificial age hardening treatment, the heat treatment of which is generally called T6 treatment. After providing the shoe with T6 treatment, the strength and the hardness of the shoe are extremely high. Besides, for example, the shoe may be provided not with T6 treatment but with T7 treatment. After the heat treatment, the base member of the shoe is formed into the predetermined shape by grinding. Since the base member 146 in the present embodiment is made of aluminum alloy, the swash plate type compressor may be relatively light in weight.

The inner layer 150 is formed by electroless plating with nickel eutectic with phosphorus (Ni—P electroless plating), and the thickness of the inner layer 150 is 25 $\mu$m. The inner layer 150 is formed by immersing the base member 146 in a plating bath filled with a predetermined composition of plating solution under a predetermined condition. In each of the shoes 76, the Ni—P electroless plating layer forming the inner layer 150 contains 8% of phosphorus in weight, and performs the hardness of Hv500 or above (Hv denotes Vickers hardness). The content may appropriately include phosphorus in the range of 7% to 9% in weight in response to required characteristics. Since each of the shoes 76 includes such the inner layer 150, manufacturing costs of the shoes 76 is relatively low for their relatively thick layers, and the metal plating layer 148 sufficiently adhering to the base member 146 is provided for the shoes 76 for use in the swash plate type compressor.

The outer layer 152 is formed by electroless plating with nickel eutectic with phosphorus, boron and tungsten (Ni—P—B—W electroless plating), and the thickness of the outer layer 152 is 25 $\mu$m. The outer layer 152, as well as the inner layer 150, is formed by immersing the base member 146 coated with the inner layer 150 in a plating bath filled with a predetermined composition of plating solution under a predetermined condition. In each of the shoes 76, the Ni—P—B—W electroless plating forming the outer layer 152 contains 2% of phosphorus, 0.03% of boron and 0.1% of tungsten in weight, and performs the hardness of Hv650 or above due to the advantageous effect of a series of electroless plating with nickel eutectic with phosphorus and boron (Ni—P—B electroless plating). The contents may appropriately include phosphorus in the ranges of 1 % to 3%, boron of 0.01% to 0.05% and tungsten of 0.02% to 0.2% in weight, respectively, in response to required characteristics. Since each of the shoes 76 in the present embodiment includes the outer layer 152, the shoe 76 performs relatively high abrasion resistance.

The sum of the thickness of the inner layer 150 and the thickness of the outer layer 152 is 50 $\mu$m, and each of the shoes 76 includes the relatively thick metal plating layer 148. Since each of the shoes 76 having the above-described relatively high hardness and the relatively thick metal plating layer 148 highly maintains its shape, the base member 146 is efficiently inhibited from being flawed. Thereby, the shoes 76 each slide smoothly, and maintain required characteristics relatively for a long time. Also, approximately the same thickness of the metal plating layer 148 coats the entire surface of the base member 146 of each of the shoes 76, and all of the metal plating layer 148 is relatively thick. Accordingly, since the metal plating layer 148 is thick not only at the plane surface 138 but also at the spherical surface 132, the shoes 76 each slide smoothly with respect to the swash plate 60 and the piston 14, respectively.

The swash plate 60, which slides with respect to the shoes 76, is made of ductile iron FCD700. An aluminum layer 162 is formed on the sliding surface 140 of the base member 160 by metal spraying, and a lubricant layer 164 is further formed on the aluminum layer 162. The layer formed on the surface of the base member 160 may be another metal layer other than the aluminum layer 162. Likewise, similar layers are formed on the sliding surface 142. Besides, the thickness of the aluminum layer 162 and the lubricant layer 164 are exaggerated in FIG. 2, for easier understanding. Since an iron series material is relatively low costs, a compressor with a swash plate made of iron series is also relatively low costs. In addition, when operating the compressor with constant displacement, the inclination angle of the swash plate is desired to be constant. Since the swash plate made of iron series is relatively large in weight, the inclination angle of the swash plate can be stable due to its inertial force. Therefore, rotation of the swash plate may further be stable by employing a shoe made of aluminum alloy, which is relatively light in weight. Since the shape of the swash plate made of iron series is complicated, the swash plate is preferably manufactured by molding. Therefore, the material of the swash plate is preferably cast iron, and is more preferably ductile cast iron having relatively high strength and high durability, and is much more preferably FCD700 having further high strength. Also, the strength of the lubricant layer is less than that of the base member of the swash plate. When the lubricant layer is removed due to abrasion or peeling, the base member directly slides with respect to the shoe. Thereby, sliding performance of the swash plate deteriorates. When the base member of the swash plate abrades due to a direct slide, sliding performance of the swash plate further deteriorates. In the present embodiment, the aluminum layer 162 is formed between the base member 160 and the lubricant layer 164. Therefore, even if the lubricant layer 164 is removed, the swash plate 60 still ensures high sliding performance due to high sliding performance of the aluminum layer 162. Besides, the aluminum layer 162 may be changed into another metal spraying layer. However, since forming the metal spraying layer by aluminum is relatively low costs, the aluminum layer 162 is preferable.

The lubricant layer 164 is made of polyamideimide, which is a synthetic resin, dispersedly containing molybdenum disulfide and graphite as a solid lubricant. Since the swash plate rotates at a high speed, the swash plate and the shoes slide under relatively hard conditions. Therefore, the lubricant layer is formed on the sliding surface of the swash plate for ensuring lubrication between the sliding surfaces. Thereby, friction generated between the sliding surfaces is reduced, and the compressor smoothly operates. For example, a lubricant layer made of synthetic resin containing a solid lubricant is formed on the metal spraying layer. Particularly, synthetic resin containing a solid lubricant may be applied. In such a state, the solid lubricant includes at least one of molybdenum disulfide, boron nitride, tungsten disulfide, graphite and polytetrafluoroethylene. Also, the synthetic resin includes at least one of polyamideimide, epoxy resin, polyether ketone and phenolic resin. Since the strength of the lubricant layer is relatively low, the lubricant layer may be easily peeled off due to flaws of the shoes. However, in the present embodiment, the shoes 76 include relatively thick metal plating layers 148, and the metal plating layers 148 are formed on the sliding surfaces of the shoes 76. Thereby, the shoes 76 are inhibited from being flawed. Accordingly, the shoes 76 rarely flaw the lubricant layer 164 of the swash plate 60, and relatively high sliding performance lasts relatively for a long time. Also, the lubricant layer 164 abrades or peels off due to some causes. However, the thickness of the aluminum layer 162 is 60 $\mu$m, the aluminum layer 162 inhibits the base member 160 from directly sliding, and maintains a smooth slide. The metal spraying layer may be formed between the lubricant layer and the base member of the swash plate for reducing friction generated between the sliding surfaces. Also, the sliding surface of the swash plate made of iron series may be hardened by quenching. When the strength of the surface of the swash plate increases, the sliding surface of the swash plate with respect to the shoe is inhibited from abrading. Thereby, durability of the swash plate improves. Additionally, the metal spraying layer causes manufacturing costs of the swash plate to increase. Therefore, since the lubricant layer may directly be formed on the surface of the base member, which is hardened by quenching, the compressor ensures relatively high durability and low costs.

According to the present embodiment, since the above-described shoes 76 and the swash plate 60 perform their various kinds of characteristics, the shoes 76 and the swash plate 60 slide smoothly, and the swash plate type compressor smoothly operates. Thereby, the swash plate type compressor maintains a smooth slide relatively for a long time, and performs relatively high durability.

The present invention is not limited to the embodiment described above, but may be modified into the following examples.

For example, the present invention may be applied to a swash plate type compressor with a double-headed piston, having two heads on both sides of the engaging portion relative to the swash plate, or may be applied to a fixed displacement compressor.

In the present embodiment, the metal plating layer 148 includes two layers 150, 152, the inner layer 150 and the outer layer 152. However, the number of the layers is not limited. A plurality of layers more than two layers may coat the base member of the shoe. Also, a single layer may coat the base member of the shoe. However, a relatively thick and high quality metal plating layer may not be formed with a single layer. A relatively thick plating layer may be formed with a plurality of layers. Additionally, characteristics of each layer may be different from one another. Thereby, the metal plating layer with various characteristics may be performed. Also, as the number of layers for forming the metal plating layer increases, plating process also increases. Therefore, when the metal plating layer includes two layers, manufacturing of the shoe may be relatively simple and low costs. Also, only the part of the metal plating layer may include two layers. Also, the thickness of the part of each layer may be varied.

In the present embodiment, the metal plating layer 148 coats the entire surface of the shoe 76. However, the metal plating layer may coat a part of surface of the shoe. For example, the part of surface includes a sliding surface of the shoe, which requires high sliding performance, or includes a portion, which easily flaws upon assembling. In the swash plate type compressor, since the swash plate is rotated at a high speed, the shoe slides with respect to the swash plate under hard conditions. Also, a lubricant layer is formed on the sliding surface of the swash plate, and the shoe may peel off the lubricant layer when the shoe is flawed, with a consequence of deteriorating sliding performance. Therefore, the shoe is inhibited from being flawed by coating the sliding surface of the shoe with the metal plating layer. Thereby, sliding performance is ensured.

In the present embodiment, the hardness of the inner layer 150 of the metal plating layer 148 is 500 Hv or above, and the hardness of the outer layer 152 of the metal plating layer 148 is 650 Hv or above. However, the hardness of the layer is not limited. The layer having a higher hardness than aluminum alloy forming the base member of the shoe sufficiently inhibits flaws, especially the outer layer. Therefore, the metal plating layer having the hardness of Hv300 or above performs sufficient abrasion resistance, and sufficiently inhibits the shoe from being flawed.

In the present embodiment, the metal plating layer 148 is formed by a series of electroless plating with nickel (Ni electroless plating). However, for example, the metal plating layer may be formed by a series of electroless plating with cobalt eutectic with phosphorus, or by hard chrome plating. The shoe slides with respect to the swash plate and the piston. Particularly, the areas of the sliding surfaces of the shoe and the piston are relatively large. According to electroless plating, the metal plating layer becomes uniform. Thereby, the relatively large area of the sliding surface of the shoe is coated with the metal plating layer having a uniform thickness. Additionally, the metal plating layer is also uniformly formed by a series of Ni electroless plating such as Ni—P electroless plating and electroless plating with nickel eutectic with boron (Ni—B electroless plating). In addition, the layer has the hardness of Hv500 or above when solidified. Thereby, the layer performs relatively high abrasion resistance and anti-corrosion. Therefore, the base member made of aluminum alloy is inhibited from deforming, and the compressor performs relatively high abrasion resistance and anti-corrosion. Also, the metal plating layer, which is formed by Ni—P electroless plating, firmly adheres to aluminum alloy forming the base member, and is formed in a short time by utilizing low cost material for a plating bath, and also performs high anti-corrosion. Particularly, the metal plating layer, which is formed by Ni—P electroless plating, is relatively low costs and high adhesive to aluminum alloy forming the base member. Therefore, the metal plating layer may desirably be formed by Ni—P electroless plating.

In the present embodiment, the outer layer 152 of the shoe 76 may be formed by Ni—P—B electroless plating, and the inner layer 150 of the shoe 76 may be formed by Ni—P electroless plating. Also, the outer layer 152 may be formed by Ni—P—B—W electroless plating. Also, the inner layer 150 may be formed by Ni—P electroless plating. Also, the outer layer 152 may contain a solid lubricant, which includes at least one of molybdenum disulfide, boron nitride, tungsten disulfide, graphite and polytetrafluoroethylene. In such a state, at least one of frictions generated between the sliding surfaces of the shoe and the swash plate, and between the sliding surfaces of the shoe and the piston, is reduced. For example, even if lubricant oil is insufficient at a moment, or even if pressure applied to the sliding surfaces increases, lubrication is ensured. Accordingly, sliding performance of the shoe further improves. Also, when the outer layer 152 is formed by a series of Ni electroless plating, the outer layer 152 includes a solid lubricant by dispersing the solid lubricant in a plating bath, stirring sufficiently, and forming integrally with the plating layer.

In the present embodiment, each of the thickness of the outer and inner layers 152, 150 of the metal plating layer 148 is the same 25 $\mu$m. Namely, the total thickness of the outer and the inner layers 152, 150 is 50 $\mu$m. However, when relatively high sliding performance and durability are required, the outer layer may be thicker than the inner layer. When the outer layer is formed thicker than the inner layer, the shoe reflects the characteristics of the outer layer. Thereby, the advantageous effects of the outer layer are obtained. For example, when the outer layer is formed by Ni—P—B electroless plating, the shoe performs relatively high hardness, high abrasion resistance and high oxidation resistance. Also, sliding performance of the shoe reflects the characteristics of the outer layer. Accordingly, when the inner and the outer layers are respectively formed by Ni—P electroless plating and Ni—P—B electroless plating, and when sliding performance and durability are focused, the thickness of the outer layer may be two thirds of the total thickness of the metal plating layer or above, preferably, four fifth of the total thickness of the metal plating layer or above. Additionally, when the metal plating layer, or the outer and the inner layers, may be thicker than that of the present embodiment, for example, the thickness of the metal plating layer is 70 $\mu$m or above, durability of the shoe further improves. Thereby, relatively high sliding performance further lasts. Especially, when the thickness of the metal plating layer is 100 $\mu$m or above, durability of the shoe prominently improves. Thereby, relatively high sliding performance prominently lasts. On the contrary, when manufacturing costs are required to be reduced, the inner layer may be thicker than the outer layer. When the inner layer is formed thicker than the outer layer, the shoe reflects the characteristics of the inner layer. For example, when the inner layer is formed by Ni—P electroless plating, manufacturing cost is reduced, and the plating layer is also formed relatively in a short time. Accordingly, when the inner and the outer layers are respectively formed by Ni—P electroless plating and Ni—P—B electroless plating, and when the plating cost is focused, the thickness of the inner layer may be two thirds of the total thickness of the metal plating layer or above, preferably, four fifth of the total thickness of the metal plating layer or above.

A lubricant layer made of synthetic resin dispersedly containing a solid lubricant may be formed on at least the part of outer layer of the metal plating layer. For example, synthetic resin layer dispersedly containing the solid lubricant is formed on the surface of the metal plating layer by tumbling or spraying, and after that the synthetic resin layer is solidified, thus forming the lubricant layer. The synthetic resin forming the lubricant layer may include at least one of polyamideimide, epoxy resin, polyether ketone and phenolic resin. Also, the solid lubricant may include at least one of molybdenum disulfide, boron nitride, tungsten disulfide, graphite and polytetrafluoroethylene.

An experiment is performed on the thickness of the metal plating layer and flaws of the shoes. In the swash plate type compressor described above, the thickness of the metal plating layer formed on the surface of each of the shoes is varied, and the flaws are checked, respectively. Also, the surfaces of metal plating layers are checked just after forming the metal plating layers. This experiment will now be described.

The base member of each of the shoes is made of Al—Si series alloy corresponding to A4032, the inner layer of the metal plating layer is formed by Ni—P electroless plating, and the outer layer of the metal plating layer is formed by Ni—P—B—W electroless plating. The swash plate type compressor including the swash plate and the piston is constructed as described above. The flaws on each of the shoes was scored on condition that the swash plate is rotated ten times with powdery stainless steel, the particle of which is 50 $\mu$m in average diameter, being diffusively put on the surface of the swash plate, with being sandwiched by the shoe and the swash plate, and with 784N being loaded on the shoes each. The test comparatively checks how easy to be flawed under an actual operation.

The shoes each were visually checked after the swash plate was rotated. The one without any flaws or almost without any flaws scores ○, the one with a few flaws scores Δ, and the one with a dent scores X. Also, the surfaces of the metal plating layers of the shoes were checked based on its appearance before the experiment. The one without any defect such as a pinhole and a rough surface scores ○, and the one with such defect scores X. Furthermore, a total score was determined based on the above two items. The excellent one scores ○, the good one scores Δ, and the defective one scores X, respectively. The following TABLE 1 indicates the thickness of the inner layer and the outer layer, the total thickness of the metal plating layer, a degree of the flaws according to an operating test and a result of an appearance test.

TABLE 1

| | THICKNESS OF METAL PLATING LAYER (μm) | | | SCORE | | |
|---|---|---|---|---|---|---|
| No. | INNER LAYER | OUTER LAYER | TOTAL | FLAW | APPEARANCE | TOTAL |
| #1 | 3 | 5 | 8 | x | ○ | x |
| #2 | 3 | 17 | 20 | Δ | ○ | Δ |
| #3 | 3 | 27 | 30 | Δ | ○ | Δ |
| #4 | 3 | 37 | 40 | ○ | ○ | ○ |
| #5 | 3 | 47 | 50 | ○ | ○ | ○ |
| #6 | 25 | 25 | 50 | ○ | ○ | ○ |
| #7 | 3 | 97 | 100 | ○ | ○ | ○ |
| #8 | 50 | 50 | 100 | ○ | ○ | ○ |
| #9 | 80 | 40 | 120 | ○ | ○ | ○ |
| #10 | 100 | 50 | 150 | ○ | ○ | ○ |
| #11 | 100 | 150 | 250 | ○ | x | x |

According to the above TABLE 1, since the total thickness of the metal plating layer of #1 shoe is 8 μm, relatively thin, the shoe was dented upon operating test. Also, #2 shoe and #3 shoe, the total thickness of the metal plating layers of which are 20 μm, 30 μm, respectively, were flawed a little. Unless relatively high durability is required, there is no trouble in a practical use. Furthermore, #4 to #11 shoes, the total thickness of the metal plating layers of which are 40 μm or above, were no flawed or mostly not flawed. Also, in the #1 to #10 shoes, as the thickness of the metal plating layer increased, the shoe was less flawed.

Meanwhile, according to the appearance test, #11 shoe, the total thickness of the metal plating layer of which is 250 μm, a pinhole and a rough surface were found, and the condition of the surface of the #11 shoe is relatively rough. Therefore, the rough condition of the surface could influence on a slide. Meanwhile, in the #1 to #10 shoes, the thickness of the metal plating layer of which are 150 μm or below, the appearances of the metal plating layers are good, and the surface roughness of them do not influence on a slide.

Consequently, the shoes withstanding in a practical use are the #2 to #10 shoes, the thickness of the metal plating layers of which range from 20 μm to 150 μm. Therefore, the metal plating layer having a thickness of 20 μm or above inhibits the base member made of aluminum alloy from being flawed, that is, the metal plating layer inhibits the base member from partially deforming. On the other hand, the metal plating layer having a thickness of above 150 μm increases plating cost, and a pinhole and a rough surface, which cause friction to increase, can be formed on the surface of the metal plating layer. Preferably, the thickness of the metal plating layer of the shoes are 40 μm or above. Additionally, combination of the thickness of the inner layer and the outer layer are permissible in a relatively wide range. Accordingly, the inner layer or the outer layer are selectively increased its thickness to design a shoe based on, for example, costs, abrasion resistance and durability.

Therefore, the present examples and embodiments are to be considered as illustrative and not restrictive and the invention is not to be limited to the details given herein but may be modified within the scope of the appended claims.

What is claimed is:

1. A shoe for use in a swash plate type compressor, interposed between a swash plate and a piston, the shoe comprising:

a base member made of aluminum alloy; and a metal plating layer coating at least a part of surface of the base member;

wherein the thickness of the metal plating layer ranges from 20 μm to 150 μm.

2. The shoe for use in the swash plate type compressor according to claim 1, wherein the metal plating layer coats at least a sliding portion with respect to the swash plate.

3. The shoe for use in the swash plate type compressor according to claim 1, wherein the metal plating layer coats the entire surface of the base member.

4. The shoe for use in the swash plate type compressor according to claim 1, wherein the thickness of the metal plating layer ranges from 30 μm to 120 μm.

5. The shoe for use in the swash plate type compressor according to claim 4, wherein the thickness of the metal plating layer is 40 μm or above.

6. The shoe for use in the swash plate type compressor according to claim 5, wherein the thickness of the metal plating layer is 50 μm or above.

7. The shoe for use in the swash plate type compressor according to claim 6, wherein the thickness of the metal plating layer is 70 μm or above.

8. The shoe for use in the swash plate type compressor according to claim 7, wherein the thickness of the metal plating layer is 100 μm or above.

9. The shoe for use in the swash plate type compressor according to claim 1, wherein the hardness of the metal plating layer is 300 Hv or above.

10. The shoe for use in the swash plate type compressor according to claim 1, wherein the metal plating layer is formed by electroless plating.

11. The shoe for use in the swash plate type compressor according to claim 10, wherein the metal plating layer is formed by one of electroless plating eutectic with nickel, electroless plating with cobalt eutectic with phosphorus, and hard chrome plating.

12. The shoe for use in the swash plate type compressor according to claim 11, wherein the metal plating layer is formed by electroless plating with nickel eutectic with phosphorus.

13. The shoe for use in the swash plate type compressor according to claim 1, wherein the metal plating layer includes a plurality of layers including at least an outermost layer for forming the surface of the metal plating layer.

14. The shoe for use in the swash plate type compressor according to claim 13, wherein the hardness of at least the outermost layer is 300 Hv or above.

15. The shoe for use in the swash plate type compressor according to claim 14, wherein at least the outermost layer is formed by electroless plating with nickel.

16. The shoe for use in the swash plate type compressor according to claim 13, wherein at least the outermost layer contains a solid lubricant.

17. The shoe for use in the swash plate type compressor according to claim 16, wherein the solid lubricant includes at least one of molybdenum disulfide, boron nitride, tungsten disulfide, graphite and polytetrafluoroethylene.

18. The shoe for use in the swash plate type compressor according to claim 1, wherein the metal plating layer includes an outermost layer forming the surface of the metal plating layer and an inner layer between the outermost layer and the base member.

19. The shoe for use in the swash plate type compressor according to claim 18, wherein the outermost layer is formed by electroless plating with nickel eutectic with phosphorus and boron, and the inner layer is formed by electroless plating with nickel eutectic with phosphorus.

20. The shoe for use in the swash plate type compressor according to claim 19, wherein the outermost layer is formed by electroless plating with nickel eutectic with phosphorus, boron and tungsten.

21. The shoe for use in the swash plate type compressor according to claim 19, wherein the inner layer is formed by electroless plating with nickel.

22. The shoe for use in the swash plate type compressor according to claim 18, wherein the outermost layer is thicker than the inner layer.

23. The shoe for use in the swash plate type compressor according to claim 18, wherein the inner layer is thicker than the outermost layer.

24. The shoe for use in the swash plate type compressor according to claim 18, wherein the outermost layer contains a solid lubricant.

25. The shoe for use in the swash plate type compressor according to claim 24, wherein the solid lubricant includes at least one of molybdenum disulfide, boron nitride, tungsten disulfide, graphite and polytetrafluoroethylene.

26. The shoe for use in the swash plate type compressor according to claim 1 further comprising:

a lubricant layer made of synthetic resin containing a solid lubricant, the lubricant layer coating at least a part of surface of the metal plating layer.

27. The shoe for use in the swash plate type compressor according to claim 26, wherein the synthetic resin includes at least one of polyamideimide, epoxy resin, polyether ketone and phenolic resin.

28. The shoe for use in the swash plate type compressor according to claim 26, wherein the solid lubricant includes at least one of molybdenum disulfide, boron nitride, tungsten disulfide, graphite and polytetrafluoroethylene.

29. A swash plate type compressor comprising:

a housing;

a drive shaft rotatably supported by the housing;

a swash plate operatively connected to the drive shaft;

a piston accommodated in the housing, the piston operatively connected to the swash plate; and a pair of shoes interposed between the swash plate and the piston, each of the shoes including:

a base member made of aluminum alloy; and metal plating layer coating at least a part of surface of the base member;

wherein the thickness of the metal plating layer ranges from 20 $\mu$m to 150 $\mu$m.

30. The swash plate type compressor according to claim 29, wherein the swash plate is made of iron series.

31. The swash plate type compressor according to claim 29, wherein the swash plate further includes a lubricant layer on a surface sliding with respect to the shoe.

32. The swash plate type compressor according to claim 31, wherein the swash plate further includes a metal spraying coating layer made of one of aluminum, copper and alloys of them, the metal spraying coating layer is formed on the surface sliding with respect to the shoe, and the lubricant layer is formed on the surface of the metal spraying coating layer.

33. The swash plate type compressor according to claim 29, wherein the swash plate is made of iron series, and the surface sliding with respect to the shoe is hardened by quenching.

* * * * *